US010295186B2

(12) United States Patent
Zink

(10) Patent No.: US 10,295,186 B2
(45) Date of Patent: May 21, 2019

(54) AIRBLAST NOZZLE WITH UPSTREAM FUEL DISTRIBUTION AND NEAR-EXIT SWIRL

(71) Applicant: Delavan Inc., Des Moines, IA (US)

(72) Inventor: Gregory Zink, Des Moines, IA (US)

(73) Assignee: DELAVAN INC. OF DES MOINES IA, Des Moines, IA (US)

( * ) Notice: Subject to any disclaimer, the term of this patent is extended or adjusted under 35 U.S.C. 154(b) by 878 days.

(21) Appl. No.: 14/228,574

(22) Filed: Mar. 28, 2014

(65) Prior Publication Data

US 2016/0161122 A1 Jun. 9, 2016

(51) Int. Cl.

| | |
|---|---|
| ***F23R 3/14*** | (2006.01) |
| ***F23R 3/28*** | (2006.01) |
| ***F23D 11/10*** | (2006.01) |
| ***F23D 11/38*** | (2006.01) |

(52) U.S. Cl.

CPC ..... *F23R 3/14* (2013.01); *F23D 11/106* (2013.01); *F23D 11/383* (2013.01); *F23R 3/286* (2013.01); *F23D 2900/00018* (2013.01); *F23D 2900/11101* (2013.01); *F23R 2900/00018* (2013.01)

(58) Field of Classification Search

CPC ..... F23R 3/14; F23D 11/383; F23D 11/103
See application file for complete search history.

(56) References Cited

U.S. PATENT DOCUMENTS 2,583,416 A * 1/1952 Clarke ..... F23R 3/32 60/738
3,529,915 A * 9/1970 Sakai ..... F23D 17/00 431/284
3,703,259 A * 11/1972 Sturgess ..... F23R 3/14 239/400
3,937,011 A * 2/1976 Caruel ..... F23D 11/107 239/404
5,167,116 A * 12/1992 Koblish ..... F23D 11/107 60/776

(Continued)

FOREIGN PATENT DOCUMENTS

| | | |
|---|---|---|
| GB | 2451144 A | 1/2009 |
| GB | 2459771 A | 11/2009 |

OTHER PUBLICATIONS

Office Action for Application No. GB1505181.6 dated Sep. 18, 2015; 7 pages.

*Primary Examiner* — Ted Kim
(74) *Attorney, Agent, or Firm* — Cantor Colburn LLP

(57) ABSTRACT

A nozzle is provided including a nozzle body having an upstream end and a downstream end aligned about a central axis. A discharge portion is positioned adjacent the downstream end. A bore extends inwardly from the downstream end over the length of the discharge portion. An opening is formed in the nozzle body adjacent the discharge portion. The opening is fluidly connected to the bore to provide an interior air flow passage. A main fuel channel extends from the upstream end to the discharge portion. At least one fuel flow branch extends through the discharge portion between the bore and an outer surface of the nozzle body. The fuel flow branch is fluidly coupled to the main fuel conduit to provide a fuel flow passage. The outer air cap is positioned about the outer surface of the discharge portion of the nozzle body to form an exterior air flow passage.

13 Claims, 6 Drawing Sheets

(56) References Cited

U.S. PATENT DOCUMENTS

| | | | | |
|---|---|---|---|---|
| 5,505,045 | A * | 4/1996 | Lee | F23D 11/107 239/424 |
| 6,820,425 | B2 * | 11/2004 | David | F23R 3/14 60/743 |
| 7,540,154 | B2 * | 6/2009 | Tanimura | F23D 17/002 60/742 |
| 2004/0003596 | A1 * | 1/2004 | Chin | F23R 3/14 60/737 |
| 2007/0271927 | A1 | 11/2007 | Myers et al. | |
| 2009/0256003 | A1 * | 10/2009 | McMasters | F23R 3/28 60/740 |
| 2013/0327849 | A1 * | 12/2013 | Matsuyama | F02M 23/12 239/406 |

* cited by examiner

AIRBLAST NOZZLE WITH UPSTREAM FUEL DISTRIBUTION AND NEAR-EXIT SWIRL

BACKGROUND OF THE INVENTION

This invention generally relates to injectors and fuel nozzles for high temperature applications, and more particularly, to fuel injectors and nozzles for gas turbine engines.

Gas turbine engines used in military and commercial aircrafts must satisfy high demands with respect to reliability, weight, performance, economic efficiency, and durability. Turbine engines typically include a plurality of fuel injectors configured to inject fuel in a spray or atomized form into a combustion chamber of the engine. The atomized air/fuel mixture is then combusted to create the energy required to sustain engine operations.

The atomization of the fuel/air mixture is generally achieved by mixing the fuel with a turbulent, non-linear air flow. To create a turbulent air flow in conventional fuel nozzles, an air swirler is positioned at an upstream end of the nozzle within the interior air flow path. As the air flows over the air swirler, the air is forced to swirl about the circumference of the passage. Because the air swirler is arranged at the upstream end of the nozzle, the swirl generated dissipates as the air travels over the length of the nozzle. By the time the air flow reaches the downstream end where it is mixed with the fuel, the swirling of the air flow may be diminished, thereby reducing the atomization of the mixture.

Conventional methods for manufacturing components of a gas turbine engine include machining, forging, and investment casting. Material selection for the components that are subjected to high mechanical loads, high vibration loads, or high thermal loads is often based upon material limits being exceeded in localized regions of the component. Because high-strength materials are needed, the cost of the component is largely driven by the amount of material used, so elimination of excess weight can significantly reduce part or component cost.

BRIEF DESCRIPTION OF THE INVENTION

According to one embodiment of the invention, a nozzle is provided including a nozzle body having an upstream end and a downstream end aligned about a central axis. A discharge portion is positioned adjacent the downstream end. A bore extends inwardly from the downstream end over the length of the discharge portion. An opening is formed in the nozzle body adjacent the discharge portion. The opening is fluidly connected to the bore to provide an interior air flow passage. A main fuel channel extends from the upstream end to the discharge portion. At least one fuel flow branch extends through the discharge portion between the bore and an outer surface of the nozzle body. The fuel flow branch is fluidly coupled to the main fuel conduit to provide a fuel flow passage. The outer air cap is positioned about the outer surface of the discharge portion of the nozzle body to form an exterior air flow passage.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
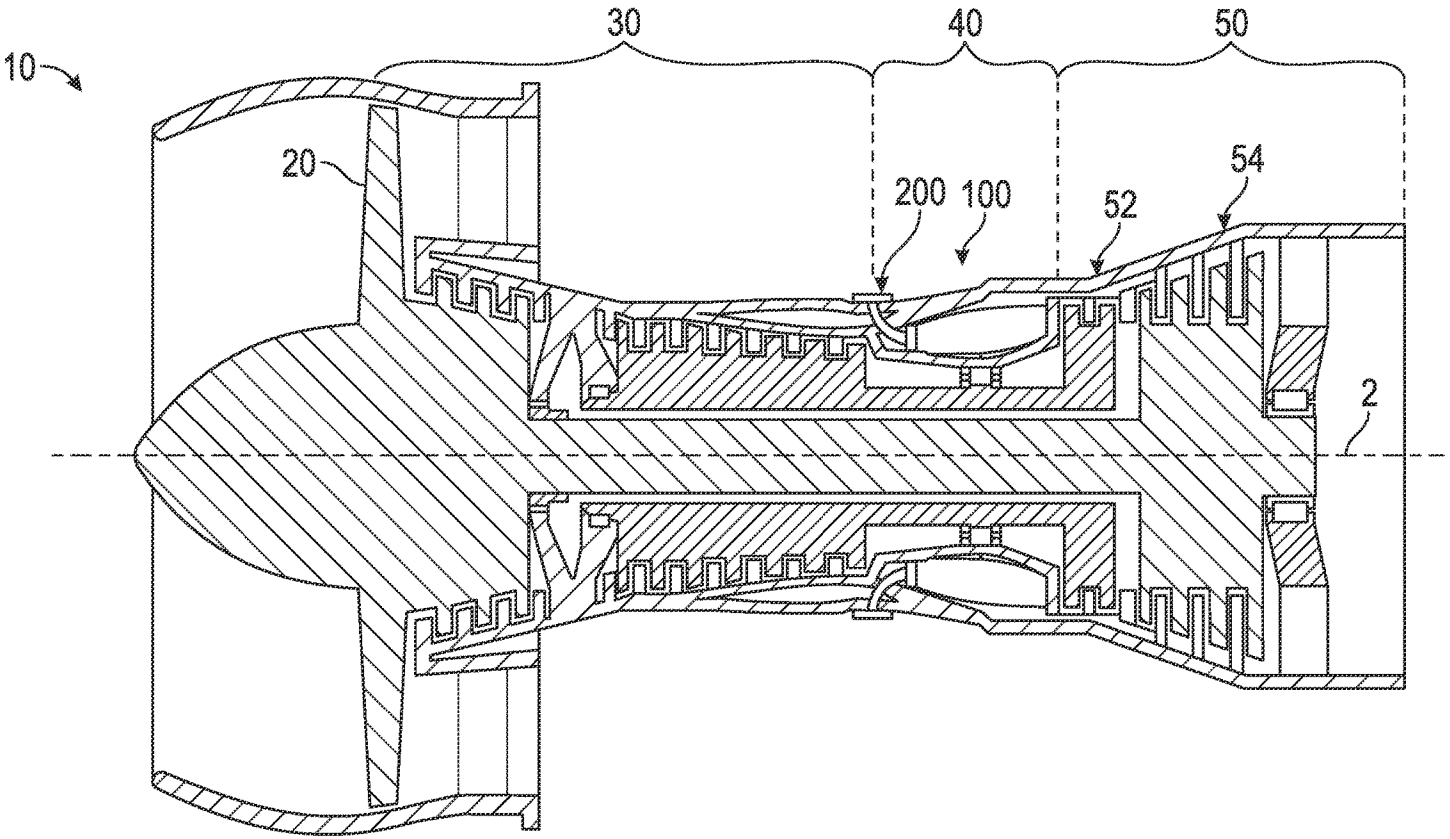
FIG. 1 is a schematic diagram of a gas turbine engine.

FIG. 1 is a schematic diagram of an embodiment of a gas turbine engine 10, such as used in an aircraft, for example. The illustrated gas turbine engine 10 incorporates a fan section 20, a compressor section 30, a combustion section 40, and a turbine section 50. The combustion section 40 incorporates a combustor 100 that includes an array of fuel injectors 200 that are positioned annularly about a centerline 2 of the engine 10 upstream of the turbine sections 52, 54. Throughout the application, the terms "forward" or "upstream" are used to refer to directions and positions located axially closer toward a fuel/air intake side of a combustion system than directions and positions referenced as "aft" or "downstream." The fuel injectors 200 are inserted into and provide fuel to one or more combustion chambers for mixing and/or ignition. It is to be understood that the combustor 100 and fuel injector 200 as disclosed herein are not limited in application to the depicted embodiment of a gas turbine engine 10, but are applicable to other types of gas turbine engines, and may also be applicable in industrial applications, such as spray drying for example.

Figure 2:
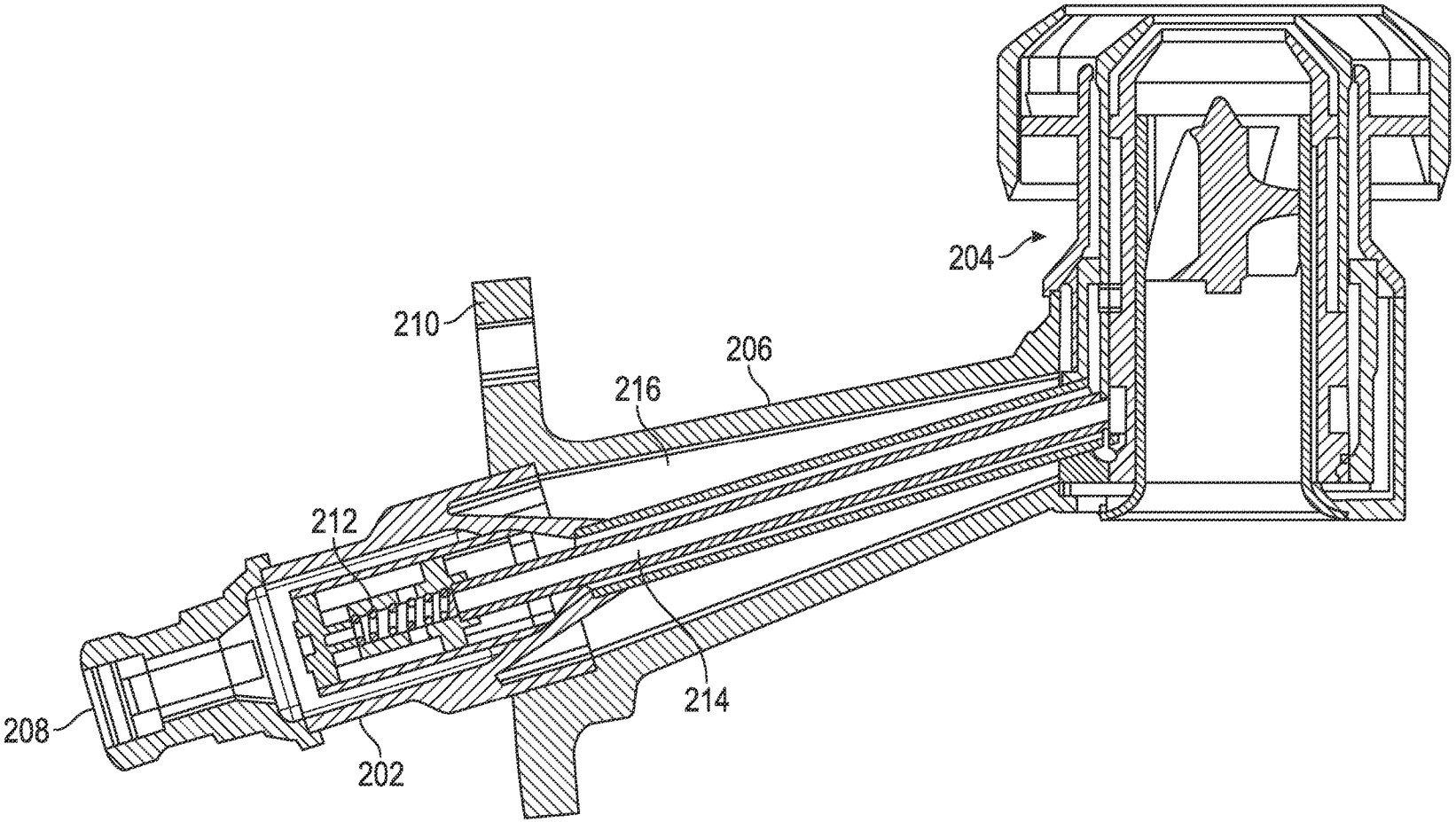
FIG. 2 is a cross-sectional view of a fuel injector according to an embodiment of the invention.
Figure 3:
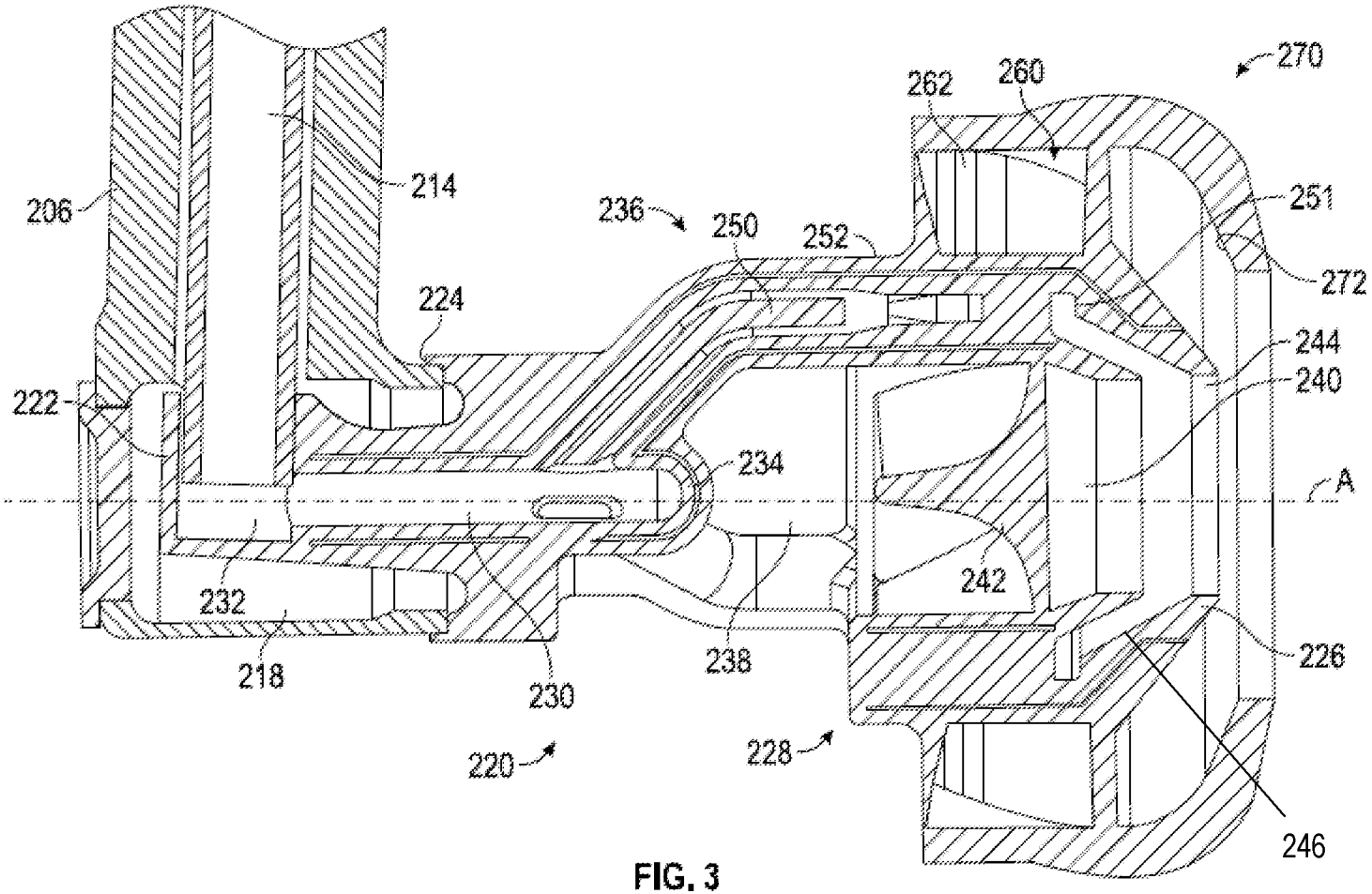
FIG. 3 is a cross-sectional view of a tip of a fuel injector according to an embodiment of the invention.
Figure 4:
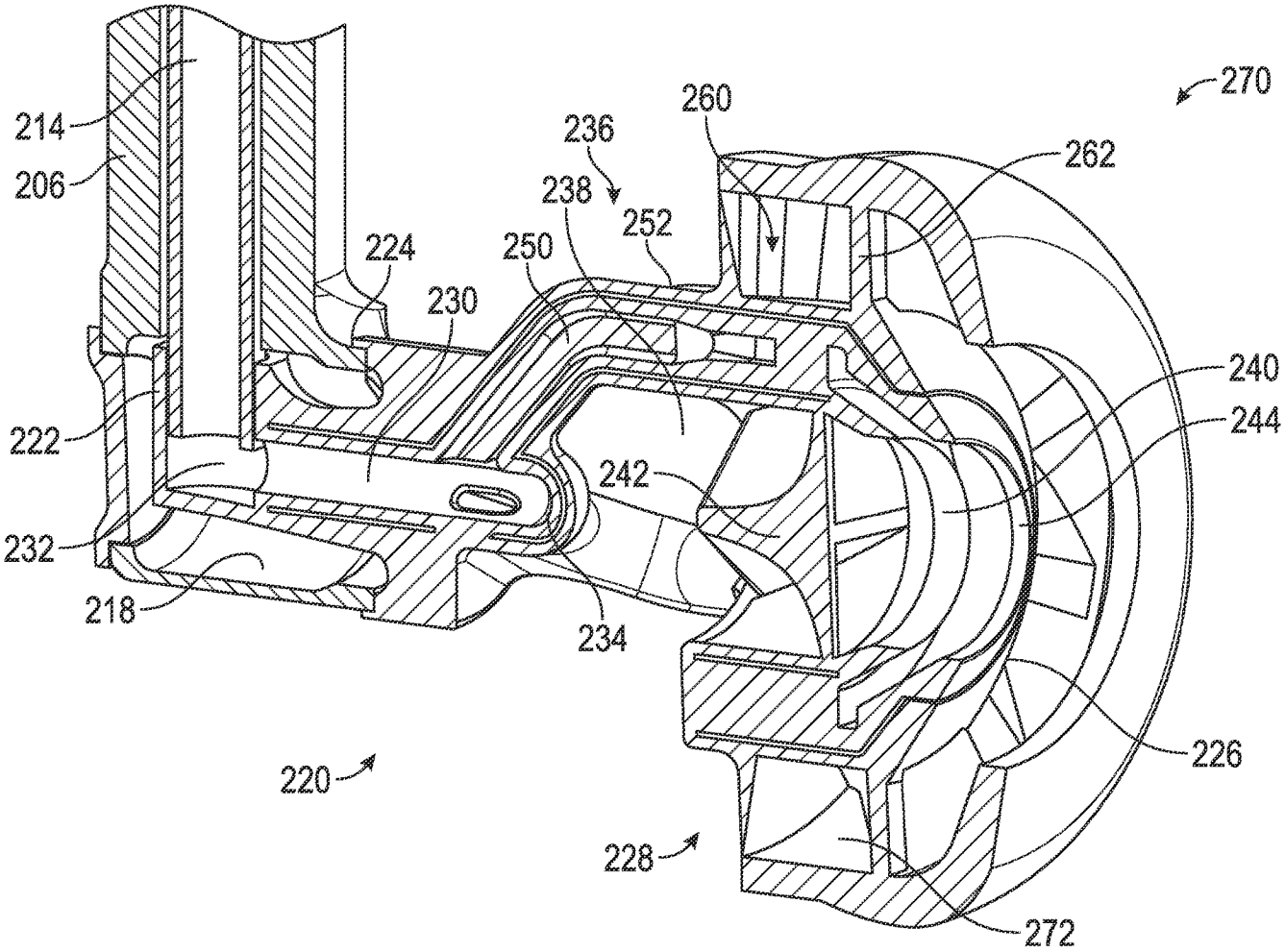
FIG. 4 is a perspective cross-sectional view of a tip of a fuel injector according to an embodiment of the invention.
Figure 5:
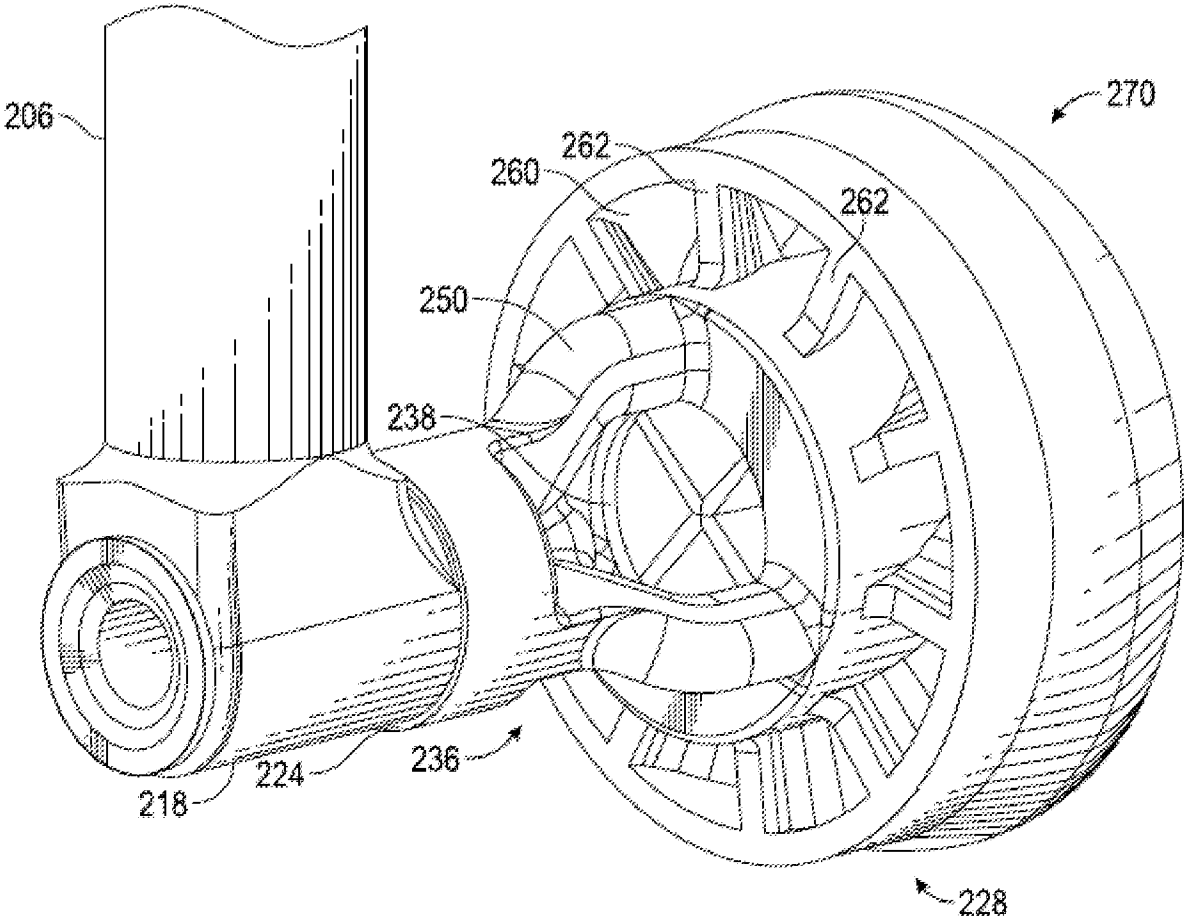
FIG. 5 is a rear perspective view of a tip of a fuel injector according to an embodiment of the invention.

A fuel injector 200 configured for use in the gas turbine engine 10 is shown in more detail in FIG. 2. The fuel injector 200 includes a fuel inlet fitting 202 and a fuel injector tip 204 connected to each other by a feed arm 206. Fuel inlet fitting 202 is provided at an upstream end 208 of the injector 200 for receiving fuel to be atomized for combustion and includes a mounting flange 210 configured to attach the injector 200 within a gas turbine engine 10. As illustrated, the fuel inlet fitting 202 may include a check valve 212 for distributing fuel from the inlet fitting 202 to a fuel conduit 214 extending through the feed arm 206 to the injector tip 204. In one embodiment, an insulation gap 216 is provided between the fuel conduit 214 and the outer wall of the feed arm 206 which may be filled with air, noble gases, a vacuum, or any other suitable form of insulation to insulate the fuel within the fuel conduit 214 from the high temperatures outside the feed arm 206.

Referring now to FIGS. 3-6, the fuel injector tip 204 of the fuel injector 200 is provided in more detail. The injector tip 204 includes a nozzle body 220 having an upstream end 222 arranged generally within an open end 218 of the feed arm 206, adjacent the fuel conduit 214. A shoulder 224 of the nozzle body 220 may be coupled to the end 218 of the feed arm 206, such as with a weld for example, to limit movement of the nozzle body 220 relative to the feed arm 206. A discharge portion 228 is located adjacent an opposite, downstream end 226 of the nozzle body 220. Extending from the upstream end 222 to the discharge portion 228 along a central axis A of the nozzle body 220 is a main fuel channel 230. An end 232 of the main fuel channel 230 is fluidly coupled to the fuel conduit 214 of the feed arm 206 to provide a portion of a flow path for the fuel through the nozzle body 220.

A bore 240, centered about the central axis A, extends generally inward from the downstream end 226 of the nozzle body 220 over the length of the discharge portion 228. As a result, the bore 240 is fluidly coupled to at least one adjacent opening 238 (discussed below) to provide an interior air flow path for directing a portion of the engine compressor discharge air through the discharge portion 228 of the nozzle body 220. In the illustrated, non-limiting embodiment, an air swirler 242 is positioned within the bore 240. The air swirler 242 is configured to increase the shear of the air as it passes through the outlet 244 at the downstream end 226 of the nozzle body 220. In one embodiment, the air swirler 242 is integrally formed with the sidewall 246 defining the bore 240 in the discharge portion 228 of the nozzle body 220.

One or more fuel flow branches 250 extend from and fluidly couple to the main fuel channel 230, such as near end 234 for example. As a result, one or more openings 238 may be formed in the middle portion 236 of the nozzle body 220 between the adjacent fuel flow branches 250. In embodiments including a plurality of fuel flow branches 250, the branches 250 may be substantially similar in size and shape. In addition, the fuel flow branches 250 may, but need not be equidistantly spaced circumferentially about the central axis A within the discharge portion 228 of the nozzle body 220.

Figure 6:
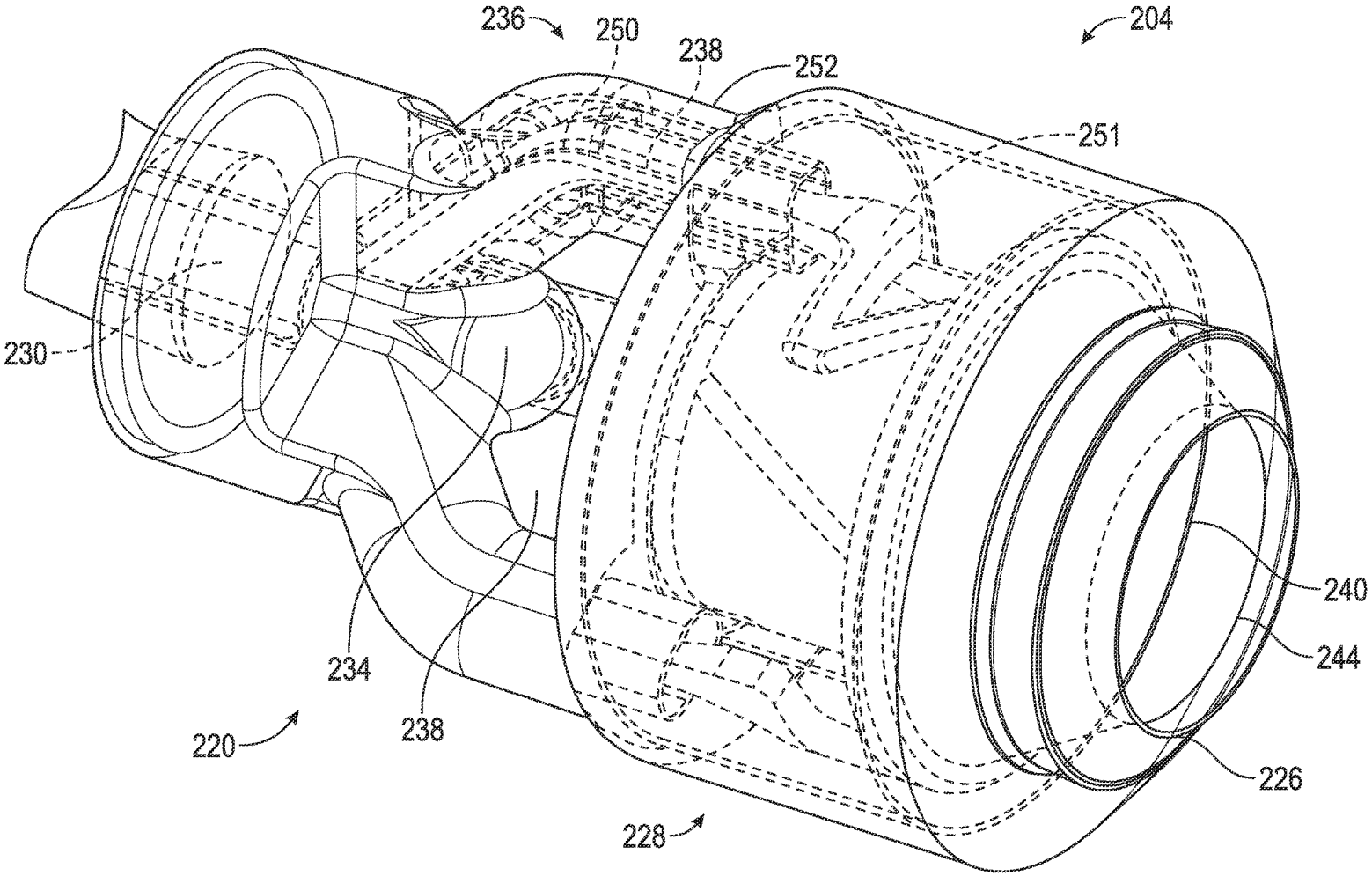
FIG. 6 is a perspective view of a tip of a fuel injector according to an embodiment of the invention.

Together, the main fuel channel 230 and each of the fuel flow branches 250 provides a fuel flow passage through the nozzle body 220 to the fuel exit slots 251 (FIG. 6). As a result, the discharge portion 228 of the nozzle body 220 functions in a manner similar to a fuel distributor and a swirler of a conventional nozzle. In addition, one or more heat shields are integrally formed with the nozzle body 220 adjacent the main fuel channel 230 and each of the fuel flow branches 250 to protect the fuel therein from the high temperatures outside the nozzle body 220. Each fuel flow branch 250 includes a first heat shield including a thin air gap disposed radially outboard of the inner air swirler, and a second heat shield including a thin air gap formed radially inboard of the outer air swirler.

The outer air swirler 260, surrounding the circumference of the outer surface 252 of a part of the discharge portion 228 includes a plurality of circumferentially disposed vanes 262. In one embodiment, the outer air swirler 260 is integrally formed with the outer surface 252 of the discharge portion 228 of the nozzle body 220. Positioned adjacent the downstream end 226 of the nozzle body 220 and surrounding the plurality of vanes 262 of the outer air swirler 260 is the outer air cap 270, which can also be formed integrally to the nozzle body 220. Together the outer air swirler 260 and the interior 272 of the adjacent outer air cap 270, define an exterior air flow passage for directing engine compressor discharge air toward the downstream end 226 of the nozzle body to mix with the fuel issuing therefrom.

In operation, fuel flows through each of the plurality of fuel flow passages defined by the fuel branches 250 within the discharge portion 228 of the nozzle body 220. As the fuel flows arrives at the outlet 244 of the downstream end 226 of the nozzle body 220, the fuel mixes with both the exterior air flow and the interior air flow. In one embodiment, a portion of each of the fuel flow branches 250 adjacent the downstream end 226 of the nozzle body is contoured to direct the fuel flow towards the interior air flow path.

In one embodiment, the nozzle body 220, including the interior air swirler 242 and the outer air swirler 260, is formed through an additive manufacturing process, such as three-dimensional printing, selective laser sintering (SLS), electron beam melting (EBM), and direct metal laser sintering (DMLS) for example. In an additive manufacturing process, a computer model of a component, such as the nozzle body 220 for example, is divided into a plurality of cross-sectional layers. Energy is applied to a generally powdered material, such as cobalt chrome, Inconel, or another high temperature metal for example, to create each of the plurality of layers. Consecutive layers are formed on top of one another to construct a component having a desired shape.

A fuel injector 200 including the nozzle 204 improves the mixture of air and fuel at the downstream end 226 of the nozzle body 220 and reduces emissions of a gas turbine engine 10. The reduction in diameter of the upstream end 222 of the nozzle body 220 and inclusion of the plurality of openings 238 therein, decrease the amount of material in the nozzle body 220, and therefore its weight. In addition, by forming the nozzle body 220 through an additive manufacturing process, the number of components, and therefore the complexity of the nozzle is reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle comprising:

a nozzle body having an upstream end and a downstream end aligned along a central axis includes:

a discharge portion being positioned adjacent the downstream end, an inwardly extending bore is formed at the downstream end and extends along the central axis over the length of the discharge portion;

at least one airflow opening formed in the nozzle body adjacent the discharge portion, the at least one opening being fluidly connected to an interior of the bore to provide an interior air flow passage;

a main fuel conduit extending along the central axis from the upstream end to the discharge portion; and two or more fuel flow branches extending through the discharge portion generally between the bore and an outer surface of the nozzle body, the fuel flow branches being fluidly coupled to the main fuel conduit to provide a fuel flow passage through the nozzle body, the fuel flow branches defining the at least one airflow opening between circumferentially adjacent fuel flow branches, and axially between the two or more fuel branches and the discharge portion, wherein the discharge portion is fluidly coupled to the interior air flow passage; and an outer air cap positioned about the outer surface of the discharge portion of the nozzle body such that an outer air flow passage is formed between an interior of the outer air cap and the nozzle body;

wherein the fuel flow passage, the interior air flow passage, and the outer air flow passage are configured to intersect near the downstream end of the nozzle body;

wherein the nozzle body further includes an interior air swirler disposed at the central axis and arranged within the bore, the interior air swirler including a plurality of interior air swirler vanes intersecting at the central axis.

2. The nozzle according to claim 1, wherein the nozzle body is formed through an additive manufacturing process.

3. The nozzle according to claim 1, wherein the interior air swirler is integrally formed with the discharge portion of the nozzle body.

4. The nozzle according to claim 1, wherein the nozzle body further comprises an outer air swirler surrounding an outer circumference of the discharge portion.

5. The nozzle according to claim 4, wherein the outer air swirler includes a plurality of circumferentially disposed vanes.

6. The nozzle according to claim 4, wherein the outer air swirler is integrally formed with the discharge portion of the nozzle body.

7. The nozzle according to claim 1, wherein the nozzle body includes a plurality of airflow openings positioned adjacent the discharge portion and fluidly coupled to the interior of the bore.

8. The nozzle according to claim 7, wherein each of the plurality of airflow openings is substantially equal in size and is equidistantly spaced about the central axis.

9. The nozzle according to claim 1, wherein each of the two or more fuel flow branches is substantially identical in size and shape and is equidistantly spaced about the central axis within the discharge portion.

10. The nozzle according to claim 1, wherein the nozzle is operably coupled to a feed arm of a fuel injector, the feed arm having a fuel conduit and the upstream end of the nozzle body being coupled to an end of the feed arm such that the fuel conduit of the feed arm and the main fuel conduit of the nozzle body are fluidly coupled.

11. The nozzle according to claim 10, wherein the fuel injector is mounted within a gas turbine engine.

12. The nozzle according to claim 1, wherein at least one heat shield is integrally formed with the nozzle body.

13. The nozzle according to claim 1, wherein fuel within the two or more fuel flow branches is provided directly to a plurality of corresponding fuel exit slots.

* * * * *